US009200417B2

(12) United States Patent
Leonhardt et al.

(10) Patent No.: US 9,200,417 B2
(45) Date of Patent: Dec. 1, 2015

(54) GUARDRAIL SYSTEM WITH A RELEASABLE POST

(71) Applicant: ENERGY ABSORPTION SYSTEMS, INC., Dallas, TX (US)

(72) Inventors: Patrick A. Leonhardt, Rocklin, CA (US); Brian E. Smith, Dallas, TX (US)

(73) Assignee: Energy Absorption Systems, Inc., Dallas, TX (US)

( * ) Notice: Subject to any disclaimer, the term of this patent is extended or adjusted under 35 U.S.C. 154(b) by 0 days.

(21) Appl. No.: 14/054,131

(22) Filed: Oct. 15, 2013

(65) Prior Publication Data

US 2014/0145132 A1 May 29, 2014

Related U.S. Application Data

(60) Provisional application No. 61/730,259, filed on Nov. 27, 2012, provisional application No. 61/774,324, filed on Mar. 7, 2013.

(51) Int. Cl.
*E01F 15/04* (2006.01)

(52) U.S. Cl.
CPC ..... *E01F 15/0423* (2013.01); *E01F 15/0461* (2013.01)

(58) Field of Classification Search
USPC ..... 256/1, 13.1, 65.02, DIG. 5; 403/2; 404/6, 9, 10
See application file for complete search history.

(56) References Cited

U.S. PATENT DOCUMENTS

| | | | |
|---|---|---|---|
| 2,520,313 | A | 8/1950 | Harris |
| 2,776,116 | A | 1/1957 | Brickman |
| 3,207,478 | A | 9/1965 | St. Pierre |
| 3,390,865 | A | 7/1968 | Jehu |
| 3,493,213 | A | 2/1970 | Ackerman |
| 4,126,403 | A | 11/1978 | Sweeney et al. |
| 4,223,872 | A | 9/1980 | Boal |
| 4,460,161 | A | 7/1984 | Grenga |
| 4,611,480 | A | 9/1986 | Willetts |
| 4,838,523 | A | 6/1989 | Humble et al. |
| 4,869,969 | A | 9/1989 | Pavlov et al. |
| 5,044,609 | A | 9/1991 | Cicinnati et al. |

(Continued)

FOREIGN PATENT DOCUMENTS

| | | | |
|---|---|---|---|
| AU | 2005211646 | A1 | 4/2007 |
| AU | 2005101085 | A4 | 4/2012 |

(Continued)

OTHER PUBLICATIONS

International Search Report and Written Opinion of the International Searching Authority for International Application No. PCT/US2013/065408, dated Mar. 4, 2014, 8 pages.

(Continued)

*Primary Examiner* — Daniel Stodola

(74) *Attorney, Agent, or Firm* — Brinks Gilson & Lione

(57) ABSTRACT

A guardrail system includes a guardrail, a support post, and a fastener joining the guardrail and the support post. The support post includes a hole receiving the fastener, a fastener retention mechanism, and a slot for the movement of the fastener during an impact. The fastener retention mechanism retains the fastener in the hole until a predetermined level of force is attained during an impact, after which the fastener is released and moves into the slot. Methods of moving the guardrail relative to the post are also provided.

22 Claims, 6 Drawing Sheets

(56) References Cited

U.S. PATENT DOCUMENTS

| | | | | |
|---|---|---|---|---|
| 5,069,576 | A | 12/1991 | Pomero | |
| 5,085,409 | A | 2/1992 | Teixeira | |
| 5,125,194 | A | 6/1992 | Granger | |
| 5,169,127 | A | 12/1992 | Eynard | |
| 5,172,891 | A | 12/1992 | Chen | |
| 5,195,727 | A | 3/1993 | Liao et al. | |
| 5,203,543 | A | 4/1993 | Fleury | |
| 5,657,966 | A | 8/1997 | Cicinnati | |
| 5,851,005 | A | 12/1998 | Muller et al. | |
| 5,957,435 | A | 9/1999 | Bronstad | |
| 6,007,269 | A | 12/1999 | Marinelli | |
| 6,036,399 | A | 3/2000 | Schalk | |
| 6,367,869 | B1 | 4/2002 | Baccouche et al. | |
| 6,409,417 | B1 * | 6/2002 | Muller et al. | 256/13.1 |
| 6,454,244 | B1 | 9/2002 | Coulson | |
| 6,530,560 | B2 | 3/2003 | King | |
| 6,886,813 | B2 | 5/2005 | Albritton | |
| 6,962,328 | B2 | 11/2005 | Bergendahl | |
| 7,101,111 | B2 | 9/2006 | Albritton | |
| 7,530,548 | B2 | 5/2009 | Ochoa | |
| 7,726,632 | B2 | 6/2010 | Amengual Pericas | |
| 7,794,173 | B2 | 9/2010 | Amengual Pericas | |
| 7,878,485 | B2 | 2/2011 | Conway et al. | |
| 7,878,486 | B2 | 2/2011 | Ochoa | |
| 8,500,103 | B2 | 8/2013 | Alberson et al. | |
| 2007/0063179 | A1 | 3/2007 | Alberson et al. | |
| 2007/0131918 | A1 | 6/2007 | James | |
| 2009/0050863 | A1 | 2/2009 | Conway et al. | |
| 2010/0293870 | A1 | 11/2010 | Amengual Pericas | |
| 2011/0084246 | A1 | 4/2011 | Amengual Pericas | |
| 2012/0003039 | A1 | 1/2012 | Wallace et al. | |
| 2012/0119175 | A1 | 5/2012 | Conway et al. | |

FOREIGN PATENT DOCUMENTS

| | | | | |
|---|---|---|---|---|
| DE | 2 019 040 | A1 | 11/1971 | |
| DE | 86 10 402 | U1 | 6/1986 | |
| DE | 35 33 963 | A2 | 6/1989 | |
| EP | 0 708 206 | A1 | 4/1996 | |
| EP | 1 624 111 | A2 | 2/2006 | |
| EP | 2128342 | A2 * | 12/2009 | E01F 15/0423 |
| FR | 2 816 344 | A1 | 5/2002 | |
| JP | 2005-120577 | A | 5/2005 | |
| KR | 980008281 | U | 4/1998 | |
| KR | 2006-0026337 | A | 3/2006 | |
| KR | 101132807 | B1 | 4/2012 | |
| WO | WO 02/18730 | A1 | 3/2002 | |
| WO | WO 2006/027394 | A1 | 3/2006 | |
| WO | WO 2007/129914 | A1 | 11/2007 | |
| WO | WO 2009/025997 | A2 | 2/2009 | |

OTHER PUBLICATIONS

Engstrand, Klas Erik, "Improvements to the Weak-Post W-Beam Guardrail," M.S. Thesis, Worcester Polytechnic Institute, 2000, 141 pages.

Michie, J.D. et al., "Guardrail Crash Test Evaluation—New Concepts and Designs," National Cooperative Highway Research Program Report 129, Highway Research Board, 1972, 52 pages.

Ray, Malcolm H. et al., "Improvements to the Weak-Post W-Beam Guardrail," Transportation Research Record 1743, Paper No. 01-2282, 2001, pp. 88-96.

Sicking, Dean L. et al., "Development of the Midwest Guardrail System," Transportation Research Record 1797, Paper No. 02-3157, 2002, pp. 44-52.

* cited by examiner 1
2
3
4
4A
5
6
8
50

101
50
5
106

104
3
2
8
204
4
22
201

GUARDRAIL SYSTEM WITH A RELEASABLE POST

This application claims benefit of U.S. Provisional Application No. 61/774,324, filed Mar. 7, 2013, and U.S. Provisional Application No. 61/730,259, filed Nov. 27, 2012, the entire disclosures of which are hereby incorporated herein by reference.

TECHNICAL FIELD

The present invention relates generally to a guardrail system having a releasable post.

BACKGROUND

Guardrails have been used for many years on our nation's highways to protected errant motorists from hazards alongside the roadway. Guardrails function by capturing errant vehicles and redirecting them away from the hazard. Hazards that are commonly protected by guardrails include trees, signs, culverts, bridge piers, steep edge drop-offs, and soft soil that could cause a vehicle to roll.

Guardrails are able to capture and redirect an errant vehicle because they have the longitudinal strength to resist the vehicle impact. This means that the steel rail and its joints are stronger than the forces generated during the vehicle impact. The steel rail is held in place by either wood or steel posts. The posts hold the rail at the proper height and are designed to bend over and fail during an impact. These posts are individually relatively weak, however when taken as a system, they are able to resist the lateral loads imposed upon the rail. Additional structural strength is provided to the rail by anchoring each end of the rail, either through the use of a crashworthy end terminal, or some other means of fixing the end of the steel rail to the ground.

Traditional guardrail systems, such as disclosed by U.S. Pat. No. 3,493,213 to Ackerman, consist of a rail which is attached to a supporting post via an offset bracket or "block-out". The offset brackets hold the guard rail panel away from its supporting posts so as to help prevent snagging of an impacting vehicle's wheels on the posts. Various types of offset brackets are commercially available, including wood blocks (hence the term "block-out"), steel I-beam sections, and also blocks formed of elastomeric materials, such as is disclosed by U.S. Pat. No. 6,530,560 to King.

Block-outs also may help maintain the height of the guardrail during a vehicle impact. For example, when a vehicle impacts a guardrail system with blockouts, the vehicle imparts lateral forces onto the rail. These forces are transmitted to the block-outs, which then transmit them to the support posts. The support posts may tend to rotate during the impact. Since the guardrail and blockouts are attached to the posts they also rotate on an arc generally centered at the point where the post is embedded in the soil. If the guardrail were directly connected to the post, this rotation would result in the guardrail being pulled downward, closer to the ground. But since the guardrail is spaced from the post, the rotation initially results in a slight gain in height of the guardrail, rather than a loss of height. Maintaining the guardrail at a consistent height may help prevent an impacting vehicle from riding up over the guardrail.

U.S. Pat. No. 7,530,548 to Ochoa discloses a guardrail system where the guardrail is directly connected to the post via a releasable fastener. The Ochoa system prevents issues with wheel snag and the guardrail being pulled down by an impact by using a weak fastener to hold the rail to the post.

Because of this, the rail is released from the post very soon after a vehicle impact. This prevents the rail and the post working together to snag the wheels of an impacting vehicle. The released rail also cannot be pulled downwards by the post as it rotates during the impact.

U.S. Pat. No. 7,878,485 to Conway discloses a guardrail system that uses a standard guardrail bolt, with a washer between the post and the guardrail. A slot allows the rail to remain at generally the same height, without disengaging from the post, as the post rotates and moves laterally during a vehicle impact. Because the post continues to hold the guardrail during much of the impact event, the post continues to restrain the rail and resists additional lateral movement.

In a similar manner, U.S. Patent Application 20120003039 to Wallace discloses a guardrail system that consists of a carriage that attaches the guardrail to the support post. When the system is impacted, the carriage is free to move upwards, but is prevented from moving downwards by an indentation in the post. Although both the Wallace and Conway systems retain the guardrail, while preventing the rotation of the post from pulling it downwards, the systems do not capture and retain the guardrail at an appropriate pre-impact height, nor do they have a means of limiting the movement of the rail up the post. For instance, guardrail systems are subject to a variety of nuisance impacts which may flex the guardrail system, without permanently deforming it or causing significant damage such as low speed impacts by vehicles, bicycles, pedestrians, or wildlife. The guardrail may also be subject to various environmental forces, such as high winds, temperature fluctuations, and high snowfall. The effects of temperature fluctuations and snowfall may combine to create particularly harsh conditions for the guardrail. Temperature fluctuations may cause the fasteners in a guardrail system to loosen over time and this is particularly troublesome for guardrail system such as the Wallace and Conway designs that depend upon the tightness of fasteners to properly locate the rail. Once the fasteners in these designs are loosened, the rail is subject to misalignment from the nuisance impacts listed previously, any also from the effects of snowfall, and the forces transmitted to the rail by passing snowplows during its removal.

SUMMARY

Briefly stated, in one aspect, one embodiment of a guardrail system includes a guardrail, a support post, and a fastener joining the guardrail and the support post. The support post includes a hole receiving the fastener, a fastener retention mechanism, and a slot for the movement of the fastener during an impact. The fastener retention mechanism retains the fastener in the hole until a predetermined level of force is attained during an impact, after which the fastener is released and moves into the slot.

In another aspect, one embodiment of a guardrail system includes a guardrail, a support post, and a fastener joining the guardrail and the support post, wherein the support post includes a hole for the fastener, a first slot for the movement of the fastener during an impact and a second slot between the hole and the first slot. In one embodiment, the width of the second slot is smaller than the width of the first slot and the diameter of the fastener.

In another aspect, a method of moving a guardrail relative to a support post includes impacting a guardrail joined to a support post with a fastener, wherein the support post includes a hole receiving the fastener, a fastener retention mechanism, and a slot, and wherein the fastener retention mechanism retains the fastener in the hole prior to the impacting of the guardrail, applying a predetermined force to the fastener retention mechanism with the fastener, moving the fastener into the slot after the predetermined force is attained, and moving the guardrail relative to the support post.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION OF THE PRESENTLY PREFERRED EMBODIMENTS

It should be understood that the term "longitudinal," as used herein, means of or relating to length or the lengthwise direction of a guardrail, which is parallel to and defines an "axial impact direction." The term "lateral," as used herein, means directed toward or running perpendicular to the side of the guardrail. The term "coupled" means connected to or engaged with, whether directly or indirectly, for example with an intervening member, and does not require the engagement to be fixed or permanent, although it may be fixed or permanent, and includes both mechanical and electrical connection. It should be understood that the use of numerical terms "first," "second" and "third" as used herein does not refer to any particular sequence or order of components; for example "first" and "second" rail sections may refer to any sequence of such sections, and is not limited to the first and second upstream rail sections unless otherwise specified. The term "frangible," as used herein means to break into two or more pieces. The term "yield" means to bend or deform, without breaking. The term "downstream," as used herein refers to the direction with the flow of traffic that is adjacent an end terminal or guardrail, whereas the term "upstream" means in a direction against or opposite the flow of traffic.

Figures 1, 2, 3:
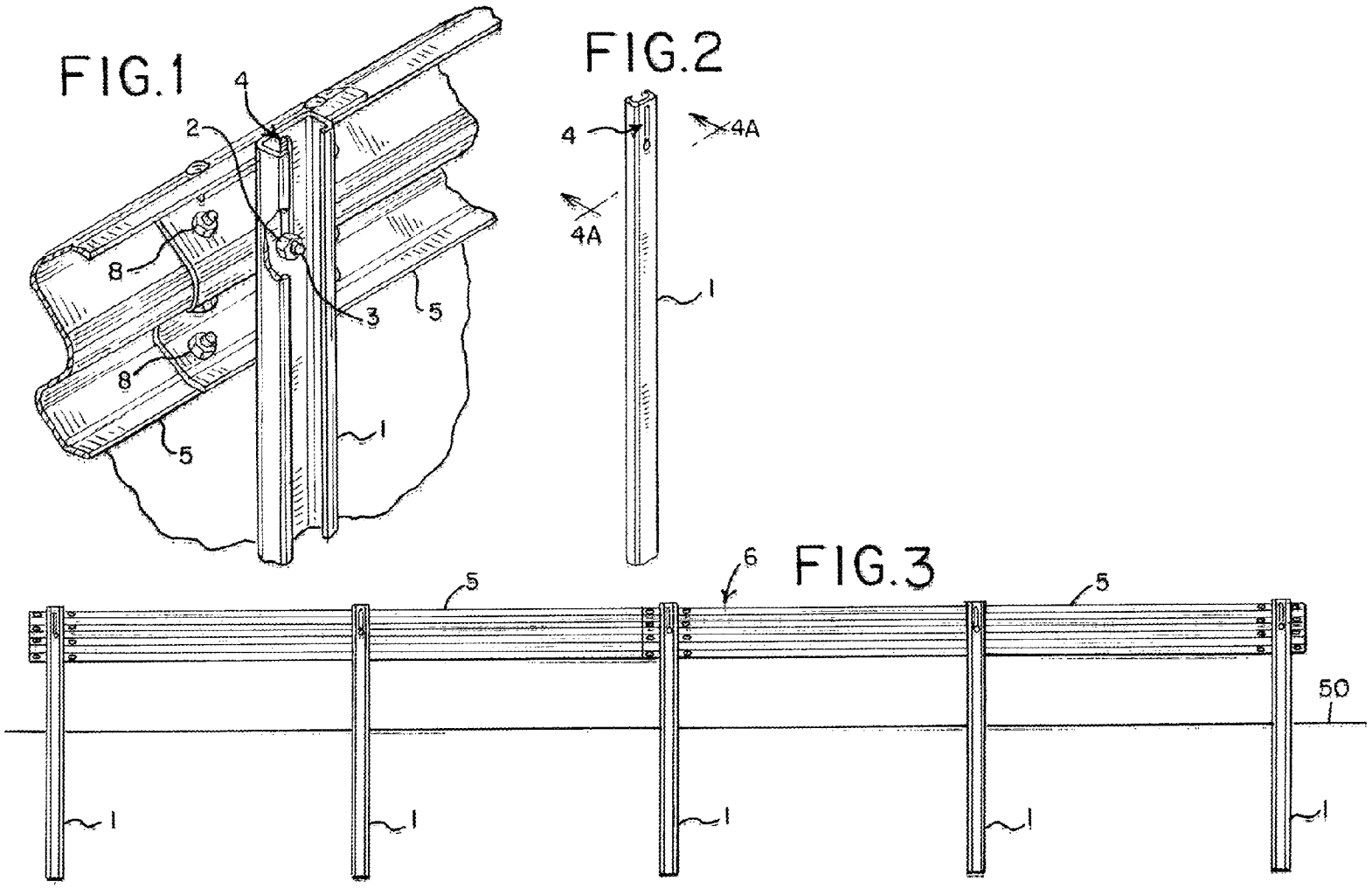
FIG. 1 is a partial view of a guardrail design with a releasable post.
FIG. 2 is a perspective view of a support post with a slot located at the top of the post.
FIG. 3 is a side view of a guardrail system.

Referring to FIG. 1, support post 1 is attached by fastener 2 and nut 3 to guardrail 5 through post slot 4. Support post 1 is shown as being attached to guardrail 5 at a joint, where two pieces of guardrail 5 are joined together by guardrail fasteners 8, although it should be understood that post 1 could be attached to guardrail 5 at locations other than where two pieces of guardrail 5 are joined to each other. Although a "W" shaped guardrail is shown, is should be understood that other guardrail shapes could be used such as "Thrie", box beam, round beam, and etc. As shown in FIG. 3, the posts 1 are embedded in the ground with a portion above the ground level 50 and a portion below the ground level 50. FIG. 3 shows the non-impact side or non-traffic side of guardrail system 6.

Figure 4A:
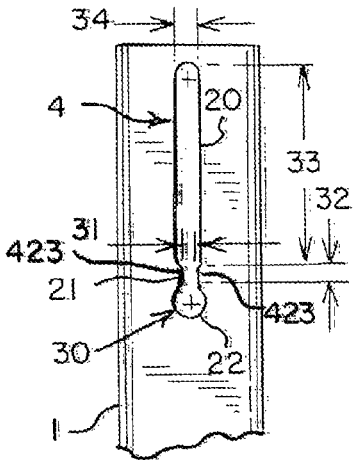
FIG. 4A is an enlarged, partial view of support post showing the details of one embodiment of a post slot.

Referring to FIG. 4A, at the lower end of post slot 4, hole 22 is provided to allow fastener 3 to attach post 1 to guardrail 5. It should be understood that the hole 22 may simply be defined as a bottom of the slot 4 as shown in FIGS. 4D and 4E. Referring to FIG. 4A, hole 22 is defined by a width 30, configured as a diameter in one embodiment, which is slightly larger in size than the width, e.g., outer diameter of fastener 2, to allow fastener 2 to be installed through post 1. Although hole 22 is shown as being round in FIG. 4A, it should be understood that it could be square, oval, quadrilateral, or other shapes, depending upon the needs of the specific design, with the fastener also having different cross-sectional shapes. The hole 22 locates the fastener, and thereby the guardrail, relative to the support post at a predetermined pre-impact height, such that the guardrail cannot drop below this height even if the fastener does not clamp the guardrail to the post.

Above hole 22 is a fastener retention mechanism. In one embodiment, the fastener retention mechanism includes a second slot or necked opening 21, which has length 32 and width 31. The slot or necked opening 21 captures fastener 2 and prevents the upward movement thereof in pre-impact conditions. In one embodiment, the width 31 is smaller than the outer diameter of fastener 2. This prevents fastener 2 from moving through fastener slot 21 except during an impact event. Slot 21 is also defined by length 32. Slot 21 is designed to release the fastener 2 during an impact event, by way of the sides of the slot deforming, for example by shearing or bending. The amount of force required for the slot 21 to release is dependent upon the width 31 and the length 32, as well as the thickness of the post material. It should be understood that slot 21 could take many forms including a constriction 423 on one or both sides of slot 21 as shown in FIGS. 4C and 4A respectively. The fastener retention mechanism may also be formed as a releasable fuse 421 as shown in FIG. 4E, configured for example as a wire, shear pin, or other device that holds and restricts the upward movement of fastener 2 and or nut 3 until a predetermined level of force has been reached. The slot 21 may also be formed by tabs or other constrictions.

Referring again to FIG. 4A, the upper portion of slot 4 is configured as slot 20, which has length 33 and width 34. The width of slot 20 is sized to allow fastener to 2 move dependent upon a predetermined force up slot 20. For instance, in some applications, width 34 of slot 20 may be sized such that width 34 is larger than the width (e.g., outer diameter) of fastener 3. In these applications, fastener 3 will be relatively free to move upwards in slot 20, after being released by fastener retainer 21. As shown in FIGS. 4C-4E, the slots 4, 20 may have the same, a lesser or a greater width than the width of the fastener, which is defined as the diameter of the fastener when the fastener has a circular cross-section. For example, in some applications, width 34 of slot 20 may be smaller than the width, e.g., outer diameter, of fastener 2. In the application where the fastener has a greater width than the slot, the fastener 2 will need to shear or bend a portion of the post material adjacent to slot 20, for example bending the sides of the slot outwardly. The friction that is generated between the sides of the slot and the fastener retards the fastener's movement.

Figure 19:
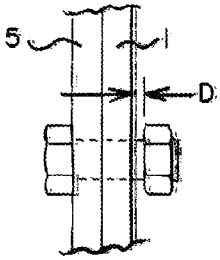
FIG. 19 is a side view of a fastener connecting a support post and a guardrail.

This will provide a retarding force, depending upon the amount of difference between width 34 of the slot 20 and the width or diameter of fastener 2. This retarding force may be used to limit how quickly fastener 2 travels upwards in slot 20. In still other applications, the force for fastener 2 to travel in slot 20 needs to be as low as possible. In these applications, the threads on faster 2 may limit the travel of nut 3 (i.e. the threads to not extend all of the way to the head) on the fastener 2 as shown in FIG. 19. In some embodiments, a slight spacing D may be introduced. In other embodiments D=0. In this embodiment, the nut 3, when fully installed, will not apply a preload between guardrail 5 and post 1, with the hole 22, and also the fastener retention mechanism 21, holding the fastener 3 and by extension, guardrail 5, at their proper pre-impact height.

Figure 4B:
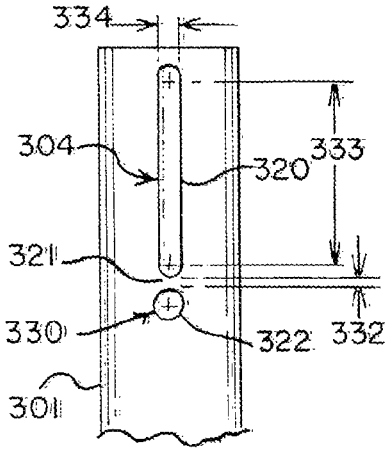
FIG. 4B is partial view of an alternative embodiment of a post including a slot.
Figure 4C:
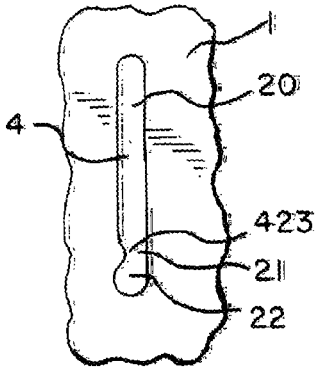
FIG. 4C is an enlarged, partial view of support post showing the details of one embodiment of a post slot.
Figure 4D:
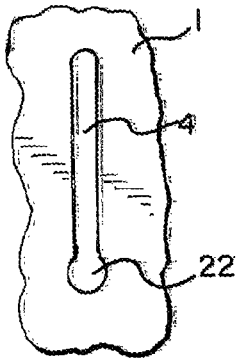
FIG. 4D is partial view of an alternative embodiment of a post including a slot.
Figure 4E:
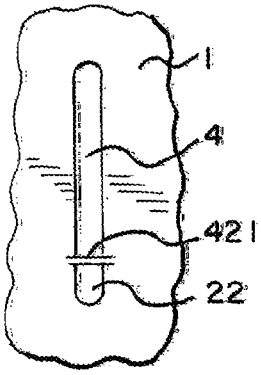
FIG. 4E is an enlarged, partial view of support post showing the details of one embodiment of a post slot.

FIG. 4B shows an alternative embodiment of post 301 and slot 304 which includes fastener hole 322, upper slot 320 and fastener retention mechanism 321. In this embodiment, the fastener retention mechanism is not a slot, but rather takes the form of a narrow band of material between hole 322 and slot 320, which also functions as a breakable fuse. In this embodiment, slot 320 is defined by width 332, the thickness of the post material, and the width 334 of slot 320. In different applications these parameters will be varied to allow for different release forces of the fastener retention mechanism 321, for example with the slot 320 having the same, a lesser or a greater width than the fastener 3. Also shown in FIG. 4B is the diameter 330 of fastener hole 322 and the length 333 of slot 320.

Figures 5, 6, 7, 8:
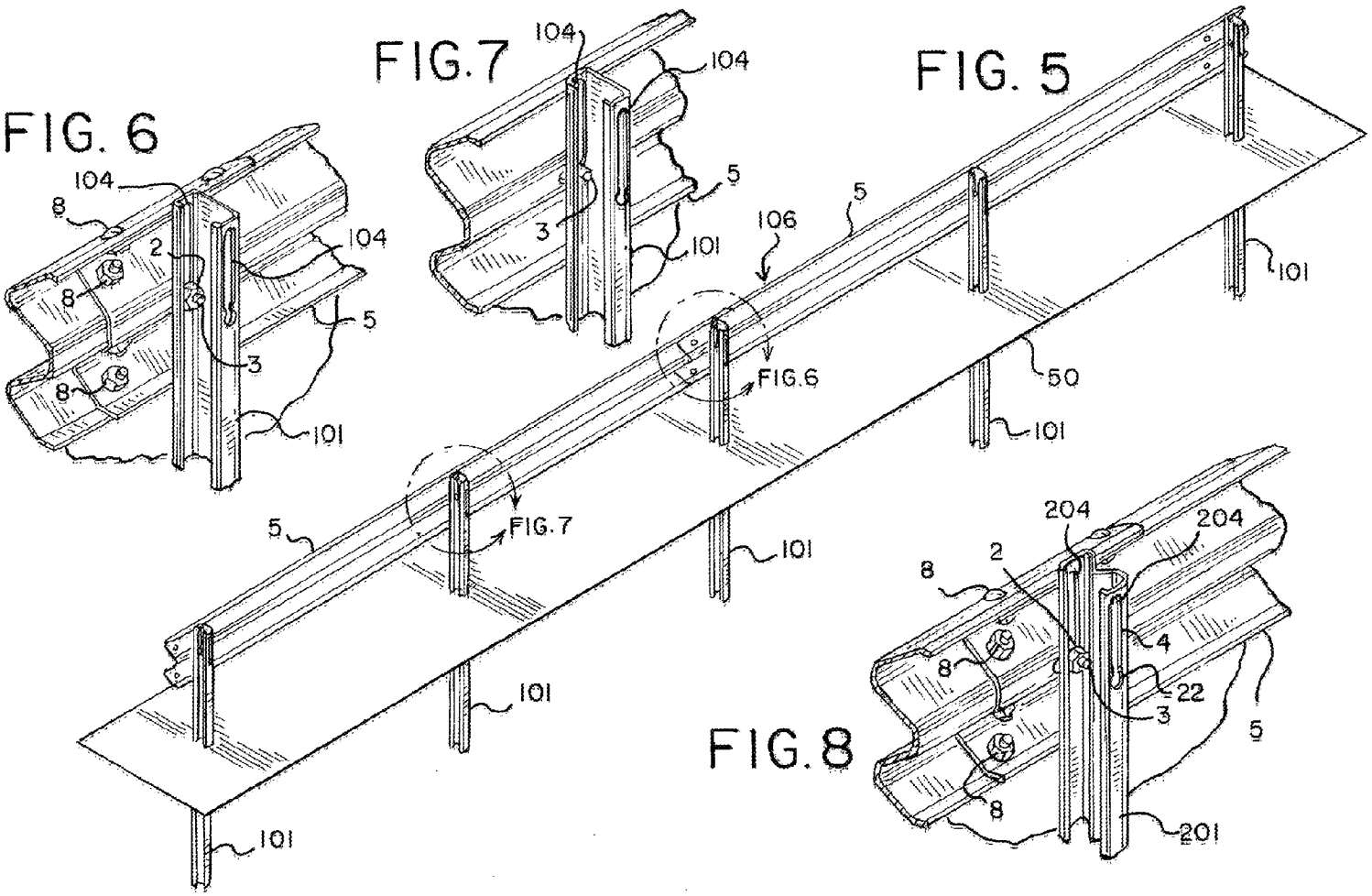
FIG. 5 is an alternative embodiment of a guardrail system.
FIG. 6 is an enlarged view of the attachment details of one of the posts.
FIG. 7 is an enlarged view of the attachment details of one of the posts.
FIG. 8 is an enlarged view of an alternate embodiment of a guardrail system.

FIG. 5 is an alternative embodiment of a guardrail system 106 consisting of posts 101 embedded in ground 50. Posts 101 support guardrail sections 5.

FIG. 6 is an enlarged view of the attachment details of one of the posts 101, showing fastener 3 and nut 3, as well as the details of lot 4. As can be seen in FIG. 6, post 101 has slots 4 on each side of the upper portion of post 101, or laterally spaced flanges thereof. This allows post 101 to be installed on either side of the roadway, with the appropriate slot 4 being used in each of these applications. FIG. 7 is an enlarged view of the attachment details of one of the posts 101, showing fastener 2, however nut 3 has been deleted from this view to allow the relationship between slot 4 and fastener 2 to be seen.

FIG. 8 is an enlarged view of an alternate embodiment of a guardrail system showing guardrails 5 and support post 201. In this embodiment, post 201 is in the form of a "sigma" post, the name of which comes from the cross-sectional shape of the post material. The use of sigma posts can be useful in some applications, as the force applied to post 201 by rail 5, fastener 2, and nut 3 is applied through the center of the section of the post, thus minimizing the torsion that is applied to the post. Although sigma and "C" shaped posts have been shown in the previous embodiments, it should be understood that posts of other shapes could also be used including, but not limited to, square round, polygonal, "s", etc. Again, the holes 22 and slots 4, along with a fastener retention mechanism, may be positioned in both of the laterally spaced flanges.

Figure 9:
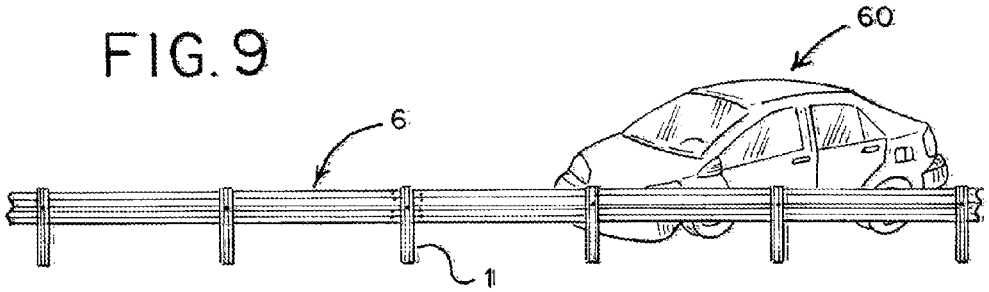
FIGS. 9-11 show the sequential steps of an impact of guardrail system by a vehicle.
Figure 10:
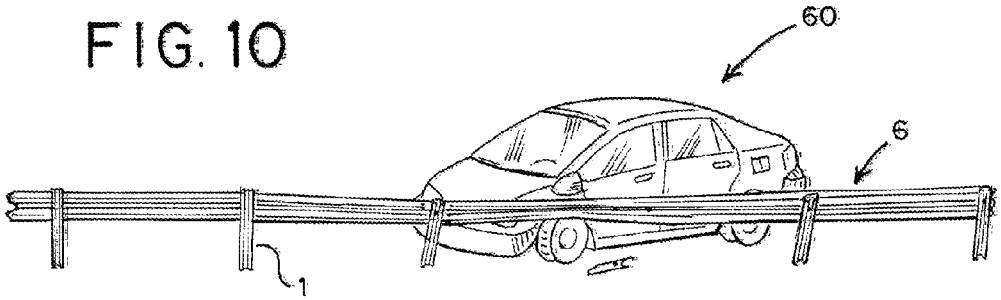
Figure 11:
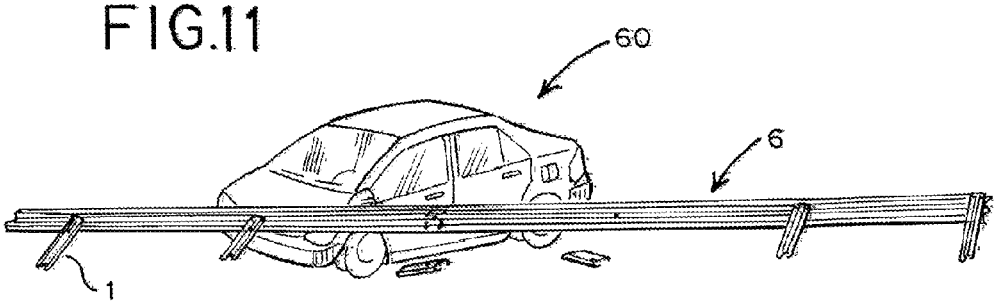

FIGS. 9, 10, and 11 depict an impact of guardrail system 6 by a vehicle 60. Each of these figures is sequential, meaning that FIG. 10 shows guardrail system 6 and vehicle 60 at a point in time after FIG. 9 and FIG. 11 shows guardrail system 6 and vehicle 60 at a point in time after FIG. 10. FIG. 9 shows the vehicle 60 soon after it has left the roadway and just before it has impacted the face of guardrail system 6. FIG. 10 shows vehicle 60 after it has impacted guardrail system 6. FIG. 10 also shows that the rail elements of guardrail system 6 have begun to engage vehicle 60 and vehicle 60 has run over one of the posts of guardrail system 6. FIG. 11 shows vehicle 60 and guardrail system 6 much later in the impact event. Guardrail system 6 has fully engaged vehicle 60 and begun to redirect it. FIG. 11 also shows that guardrail system 6 continues to contain and redirect vehicle 60, even though a number of the support posts have been run over by vehicle 60 and are no longer supporting guardrail system 6. FIG. 11 also shows that posts that are immediately upstream and downstream of the impact area have begun to bend over from the force of the impact of vehicle 60.

Figure 12:
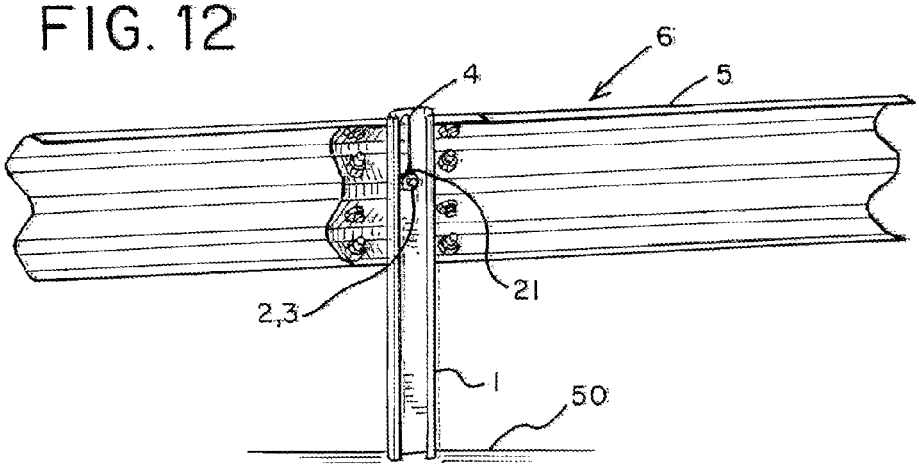
FIGS. 12-17 are enlarged views of one of the posts shown in FIGS. 9-11.
Figure 13:
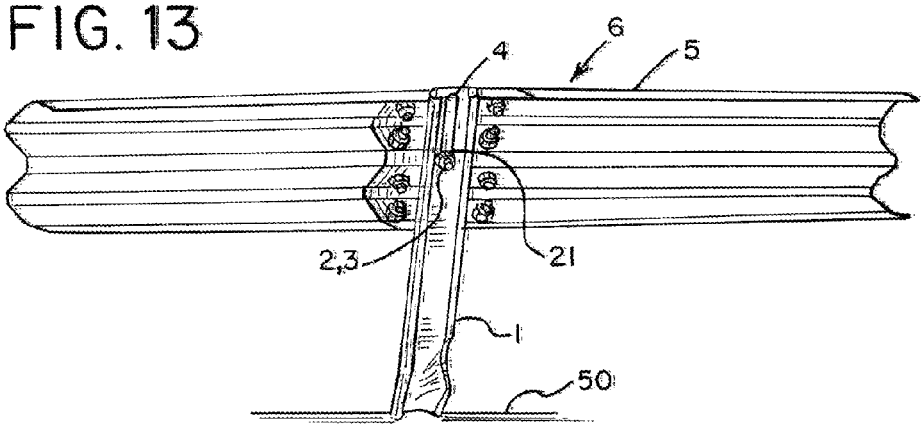
Figure 14:
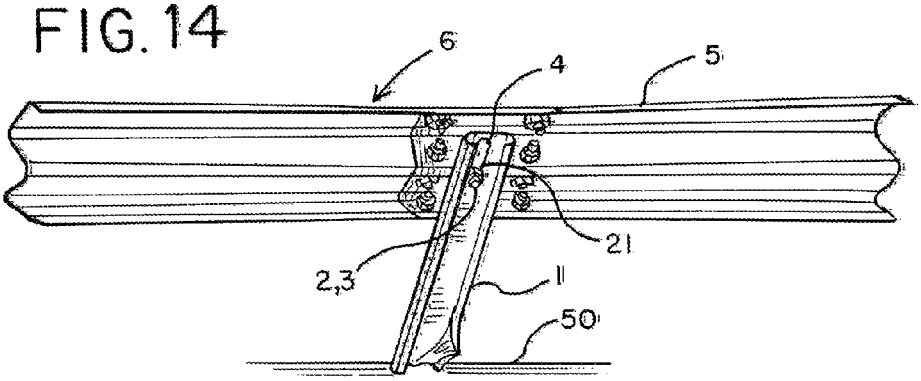

FIGS. 12 through 17 are enlarged views of one of the posts of the impact depicted in FIGS. 9, 10, and 11. Each of these figures is sequential, meaning that FIG. 13 shows guardrail system 6 at a point in time after FIG. 12, FIG. 14 shows guardrail system 6 at a point in time after FIG. 13, and etc.

FIG. 12 shows guardrail system 6 in a pre-impact condition, where support post 1 supports guardrail 5, fastener 2 attaches support post 1 to guardrail 5, and fastener 2 is held in place by nut 3. Fastener 2, at the low end of slot 4, is being held in place by fastener retainer 21.

FIG. 13 shows guardrail system 6 after it has been impacted by vehicle 60 (not shown). The lateral forces that vehicle 60 has applied to rail 5 have been transmitted to post 1, causing post 1 to buckle slightly at ground level 50. Although post 1 has moved laterally by a small amount, fastener 2 is still retained at the bottom of slot 4 by fastener retainer 21.

FIG. 14 shows guardrail system 6 later in the impact event. The lateral forces from vehicle 60 have caused the buckle at the bottom of post 1 to increase in size and this has caused post 1 to lean in a lateral direction, away from the roadside of the guardrail. This in turn has caused fastener 2 to move to the top of hole 22 and begin to bear against fastener retainer 21. Although fastener 2 is applying loading to fastener retainer 21, fastener retainer 21 is still retaining fastener 2 in hole 22.

Figure 15:
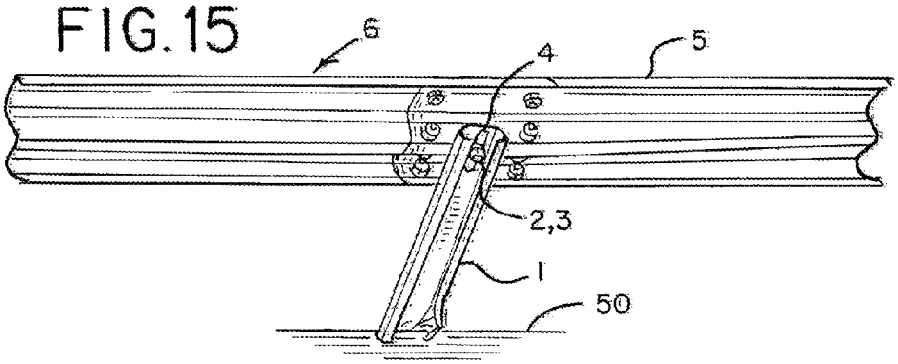

FIG. 15 shows guardrail system 6 later in the impact event. The continued loading of guardrail system 6 has caused increased lateral movement of post 1 and this in turn has caused an increase in the loading of fastener retainer 21 to the point that fastener retainer 21 has released fastener 2, allowing it to move upwards in slot 4. This in turn has allowed rail 5 to maintain its height above the ground 50, without being pulled downwards by the lateral movement of post 1. Although fastener 2 has been released by fastener retainer 21, its movement upwards in slot 4 is still retarded by the interference between the width 34 of slot 20 and the diameter of fastener 2.

Figure 16:
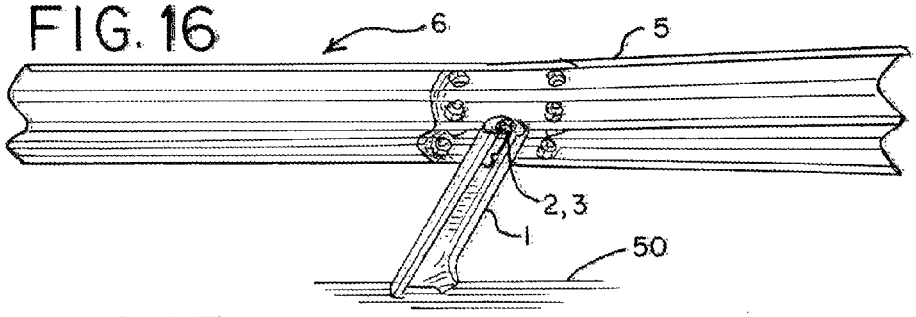
Figure 17:
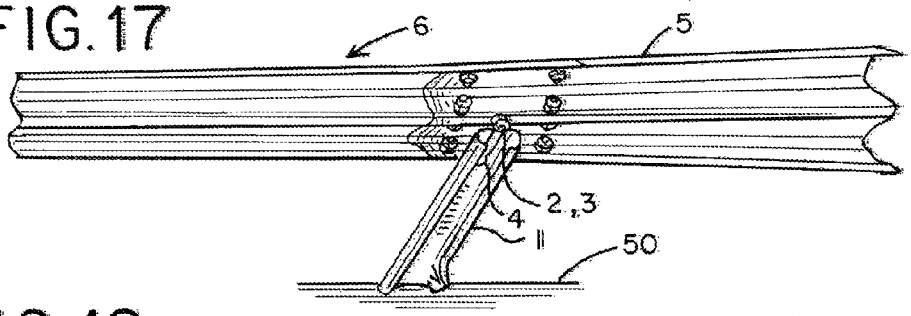

In FIG. 16, fastener 2 has moved to the top of slot 4 and is now bearing against the end of slot 4. This eventually causes the end of slot 4 to fail, as is shown in FIG. 17. Because of this failure of the end of slot 4, fastener 2 is no longer retained by slot 4 and therefore post 1 is no longer affixed to rail 5.

Figure 18:
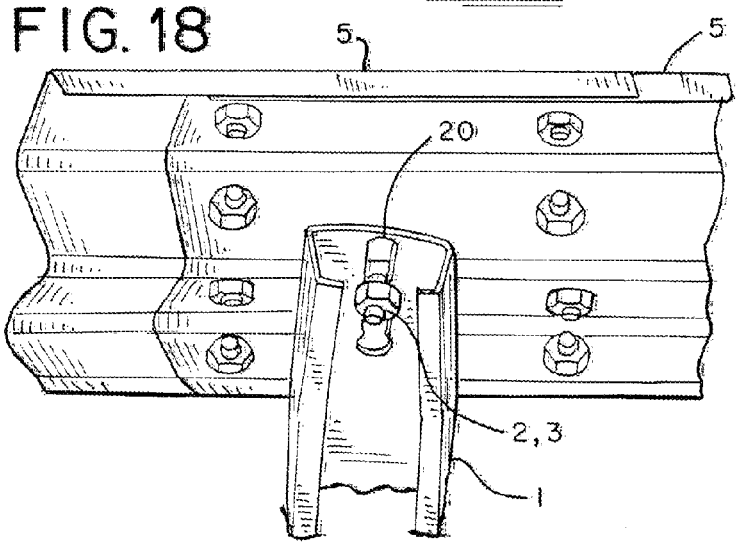
FIG. 18 is an enlarged view of the guardrail system shown in FIG. 15.

FIG. 18 is an enlarged view of the guardrail system shown in FIG. 15, at the same point in an impact event. As can be seen in FIG. 18, fastener 2 is of a larger diameter than the width 34 of slot 4, causing interference between fastener 2 and slot 20, as fastener 2 moves up slot 20. In this embodiment, the interference is not causing the material on the sides of slot 20 to shear or bend, but rather a friction force is being generated between fastener 2 and the inside walls of slot 20. These forces are also causing the cross sectional shape of post 1 to change in shape slightly, as can be seen in FIG. 18.

The various embodiments disclosed herein provide for a support post that retains the guardrail while minimizing lateral deflection of the guardrail. At the same time, the support posts allow the guardrail to remain at or near its pre-impact height, while the support post rotates about its anchorage due to the imposed impact loads. The support post also maintains the height of the guardrail in a pre-impact condition at an appropriate level.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A guardrail system comprising:

a guardrail;

a support post; and a fastener joining the guardrail and the support post, wherein the support post includes a hole receiving the fastener, a fastener retention mechanism, and a slot for the movement of the fastener during an impact, wherein the fastener retention mechanism comprises a necked opening between the hole and the slot, wherein the hole has a first width, the slot has a second width, and the necked opening has a third width less than the first and second widths, and wherein the fastener retention mechanism retains the fastener in the hole until a predetermined level of force is attained during an impact, after which the fastener is released and moves into the slot.

2. The guardrail system of claim 1 wherein the second width is less than a width of the fastener.

3. The guardrail system of claim 2 wherein the fastener retention mechanism comprises a mouth of the slot.

4. The guardrail system of claim 1 wherein the second slot has a width that is greater than a width of the fastener.

5. The guardrail system of claim 1 wherein the necked opening is formed by a constriction on only one side of a passageway between the hole and the slot.

6. The guardrail system of claim 1 wherein the necked opening is formed by a pair of constrictions on opposite sides of a passageway between the hole and slot.

7. The guardrail system of claim 1 wherein the support post comprises a pair of laterally spaced flanges, wherein each of the flanges comprises a hole and a fastener retention mechanism, wherein the fastener is disposed in only one of the holes.

8. The guardrail system of claim 1 wherein the second width is the same as the first width.

9. A guardrail system comprising:

a guardrail;

a support post; and a fastener joining the guardrail and the support post, wherein the support post includes a hole for the fastener, a first slot for the movement of the fastener during an impact and a second slot between the hole and the first slot, wherein a width of the second slot is smaller than both a width of the first slot and a width of the hole, wherein the second slot retains the fastener until a predetermined level of force is attained during an impact, and wherein the material defining the second slot is deformable such that the fastener is moveable into the first slot during an impact.

10. The guardrail system of claim 9 wherein the first slot has a width that is less than a diameter of the fastener.

11. The guardrail system of claim 9 wherein the first slot has a width that is greater than a diameter of the fastener.

12. The guardrail system of claim 9 wherein the second slot is formed by a constriction on only one side of a passageway between the hole and first slot.

13. The guardrail system of claim 9 wherein the second slot is formed by a pair of constrictions on opposite sides of a passageway between the hole and the first slot.

14. The guardrail system of claim 9 wherein the support post comprises a pair of laterally spaced flanges, wherein each of the flanges comprises a hole and first and second slots, wherein the fastener is disposed in only one of the holes.

15. The guardrail system of claim 9 wherein the first slot is the same width as the hole.

16. A method of moving a guardrail relative to a support post comprising:

impacting a guardrail joined to a support post with a fastener, wherein the support post includes a hole receiving the fastener, a fastener retention mechanism, and a slot, wherein the fastener retention mechanism comprises a mouth positioned between the slot and the hole, wherein the hole has a first width, the slot has a second width, and the mouth has a third width less than the first and second widths, and wherein the fastener retention mechanism retains the fastener in the hole prior to the impacting of the guardrail;

applying a predetermined force to the fastener retention mechanism with the fastener;

moving the fastener through the mouth and into the slot after the predetermined force is attained; and moving the guardrail relative to the support post.

17. The method of claim 16 wherein the slot has a width that is less than a diameter of the fastener.

18. The method of claim 16 wherein the slot has a width that is greater than a diameter of the fastener.

19. The method of claim 16 wherein the fastener retention mechanism comprises a necked opening between the hole and the slot and wherein the applying the predetermined force to the fastener retention mechanism comprises deforming sides of the necked opening.

20. The method of claim 19 wherein the necked opening is formed by a constriction on only one side of a passageway between the hole and the slot.

21. The method of claim 19 wherein the necked opening is formed by a pair of constrictions on opposite sides of a passageway between the hole and slot.

22. The method of claim 16 wherein the second width is the same as the first width.

* * * * *